US008157143B2

(12) United States Patent
Klamt et al.

(10) Patent No.: US 8,157,143 B2
(45) Date of Patent: Apr. 17, 2012

(54) STITCHING DEVICE AND METHOD FOR SETTING UP A STITCHING DEVICE

(75) Inventors: Holger Klamt, Leipzig (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1356 days.

(21) Appl. No.: 11/517,499

(22) Filed: Sep. 7, 2006

(65) Prior Publication Data

US 2007/0062426 A1 Mar. 22, 2007

(30) Foreign Application Priority Data

Sep. 7, 2005 (DE) ..... 10 2005 042 517

(51) Int. Cl.
*B31B 1/68* (2006.01)
*B26D 5/10* (2006.01)

(52) U.S. Cl. ..... 227/64; 227/76; 227/84; 227/85; 227/93; 227/97; 83/57

(58) Field of Classification Search ..... 227/67, 227/76, 84, 85, 93, 94, 97, 974; 83/57, 59, 83/68, 74; 270/52.18, 58.08
See application file for complete search history.

(56) References Cited

U.S. PATENT DOCUMENTS 1,748,261 A 2/1930 Walker et al.
1,757,883 A 5/1930 St. Hilaire
3,017,634 A * 1/1962 Hauck et al. ..... 59/76
3,514,027 A * 5/1970 Linden ..... 227/81
3,642,187 A * 2/1972 Barland ..... 227/84
3,848,790 A * 11/1974 Verwey et al. ..... 227/90
3,876,129 A * 4/1975 Bulka ..... 227/88
3,917,145 A * 11/1975 Graf et al. ..... 227/90
4,318,555 A * 3/1982 Adamski et al. ..... 227/7
4,335,841 A * 6/1982 Fogarasy ..... 227/90
4,358,040 A * 11/1982 Stokes ..... 227/5
4,444,347 A * 4/1984 Males ..... 227/88
(Continued)

FOREIGN PATENT DOCUMENTS

DE 577 624 6/1933
(Continued)

OTHER PUBLICATIONS

European Search Report dated Aug. 20, 2008.

*Primary Examiner* — Thanh K Truong
*Assistant Examiner* — Gloria R Weeks
(74) *Attorney, Agent, or Firm* — Laurence A. Greenberg; Werner H. Stemer; Ralph E. Locher

(57) ABSTRACT

A stitching device for producing stitching wire staples for stitching stacked sheet materials, includes a stitching head base body and a cutting box fixed to the stitching head base body. The cutting box includes a movable knife slide. A control device controls the movement sequences of the stitching head, in particular of the knife slide, for cutting off the stitching wire automatically. The stitching head base body, the cutting box and the knife slide are configured in such a way that, during interaction, the movable knife slide can be displaced relative to the stitching base body in order to cut off the stitching wire. The cutting box and the knife slide are provided with at least partly aligned openings in such a way that, during interaction between these openings and an operating device, it is possible to cut the wire off manually.

12 Claims, 3 Drawing Sheets

U.S. PATENT DOCUMENTS

| | | | | | |
|---|---|---|---|---|---|
| 4,485,955 | A | * | 12/1984 | Hagemann | 227/89 |
| 4,505,415 | A | * | 3/1985 | Gruen | 227/88 |
| 4,554,196 | A | * | 11/1985 | Meeker | 428/67 |
| 4,640,321 | A | * | 2/1987 | Varga et al. | 140/93 C |
| 4,747,531 | A | * | 5/1988 | Brinkerhoff et al. | 227/19 |
| 4,898,314 | A | * | 2/1990 | Stroh | 227/3 |
| 5,170,924 | A | * | 12/1992 | Musil | 227/111 |
| 5,592,728 | A | * | 1/1997 | Susnjara | 29/434 |
| 5,788,139 | A | | 8/1998 | Sikora | |
| 5,921,455 | A | * | 7/1999 | Dickhoff | 227/86 |
| 6,119,911 | A | | 9/2000 | Funk et al. | |
| 6,641,129 | B2 | * | 11/2003 | Ogita et al. | 270/58.08 |
| 6,746,008 | B2 | * | 6/2004 | Coombs et al. | 270/58.08 |
| 6,869,005 | B2 | * | 3/2005 | Funk et al. | 227/86 |
| 7,044,349 | B2 | * | 5/2006 | Adams et al. | 227/82 |
| 7,159,746 | B2 | * | 1/2007 | Duff | 227/86 |
| 7,210,609 | B2 | * | 5/2007 | Leiboff et al. | 227/180.1 |
| 7,337,937 | B2 | * | 3/2008 | Klamt et al. | 227/89 |
| 2002/0096549 | A1 | * | 7/2002 | Funk et al. | 227/93 |
| 2005/0067455 | A1 | * | 3/2005 | Duff | 227/91 |
| 2008/0000943 | A1 | * | 1/2008 | Keist | 227/139 |

FOREIGN PATENT DOCUMENTS

| | | | |
|---|---|---|---|
| DE | 38 24 501 | C1 | 10/1989 |
| DE | 197 14 482 | A1 | 11/1997 |
| DE | 19712876 | A1 | 10/1998 |
| DE | 100 49 471 | A1 | 4/2002 |

* cited by examiner

STITCHING DEVICE AND METHOD FOR SETTING UP A STITCHING DEVICE

CROSS REFERENCE TO RELATED APPLICATION

This application claims the priority, under 35 U.S.C. §119, of German Patent Application DE 10 2005 042 517.8, filed Sep. 7, 2005; the prior application is herewith incorporated by reference in its entirety.

BACKGROUND OF THE INVENTION

Field of the Invention

The present invention relates to a stitching, binding or stapling device for producing stitching wire staples for stitching stacked sheet materials. The stitching device includes a stitching head base body and a cutting box fixed to the stitching head base body. The cutting box has a movable knife slide. A control device controls movement sequences of the stitching device, in particular the knife slide, for automatically cutting off the stitching wire. The stitching head base body, the cutting box and the knife slide cooperate to permit the movable knife slide to be displaced relative to the stitching base body for cutting off the stitching wire. The invention also relates to a method for setting up an automatic stitching device.

Such stitching, stapling or binding devices are used in particular in gatherer stitchers for the production of gathered and stitched brochures, for example periodicals. Corresponding stitching or stapling devices of that type are disclosed, for example, by German Patent DE 44 44 220, corresponding to U.S. Pat. No. 5,516,024 or German Published, Non-Prosecuted Patent Application DE 197 12 876, corresponding to U.S. Pat. No. 6,119,911.

In stitching heads of that type, the wire pushed forward to form a staple must be aligned as a function of the stitching wire thickness and the stitching wire quality and/or its optimal position and the wire cutting length for the staple forming operation must be checked. In that case, the wire cutting length is the length of the stitching wire which is optimal to form the staple as a function of the thickness of the stitched brochure. For that purpose, with the machine at a standstill and with the guards open, at least one wire section has to be cut off manually in the stitching head. Although in the stitching heads from the prior art a corresponding knife slide can be moved manually in order to sever the stitching wire, heretofore unsuitable aids such as screwdrivers or flatnosed pliers have been used in an uncharacteristic manner and, over time, lead to damage to the stitching head, as a result of which functional faults can occur.

It would therefore be desirable if the manual cutting of the wire could be carried out without damage to the stitching head and without the production of functional faults.

SUMMARY OF THE INVENTION

It is accordingly an object of the invention to provide a stitching device and a method for setting up a stitching device, which overcome the hereinafore-mentioned disadvantages of the heretofore-known devices and methods of this general type and which permit a simply reproducible manner of carrying out manual cutting of the wire in the stitching head, so that a fault-free setting up operation with a minimized changeover time and fault-free running of the stitching heads is ensured.

With the foregoing and other objects in view there is provided, in accordance with the invention, a stitching device for producing stitching wire staples for stitching stacked sheet materials. The stitching device comprises a stitching head base body, a cutting box fixed to the stitching head base body and including a movable knife slide and a control device for controlling movement sequences of the stitching device, in particular of the knife slide, for automatically cutting off the stitching wire. The stitching head base body, the cutting box and the knife slide cooperate to permit the movable knife slide to be displaced relative to the stitching base body for cutting off the stitching wire. An operating device cooperates with at least partly aligned openings formed in the cutting box and the knife slide to permit the stitching wire to be cut off manually.

Therefore, the stitching device is thus configured specifically for the unavoidable manual wire cutting. For example, the operating device can be inserted through the opening into the stitching device in a simple way without destruction and, depending on the length of the lever, the necessary reciprocating movement of the knife slide can be carried out in a simple way and at a suitable distance. Alternatively, the operating device provided for the purpose of cutting off the wire manually can already be disposed in the holes on the stitching device.

The use of such an operating device is advantageous, in particular since the knife slide is only one of many moving parts of an appropriate stitching device, which is not necessarily easily accessible in order to find a point of action on the latter for the operating device. The time saving which is made possible by the configuration of the stitching device according to the invention is multiplied further by the fact that a plurality of such stitching devices are used in typical gatherer stitchers.

In accordance with another feature of the invention, the control device is a cam control device. This is not atypical of such substantially purely mechanical stitching devices. However, it is also conceivable, for the movement of the individual components of such a stitching device, to use individual drives, for example electric linear drives, as well and to provide an appropriate electric drive device.

In accordance with a further feature of the invention, the stitching head base body has a movable slide. The slide includes a cam track which is operatively connected to a rocker. The rocker is operatively connected at the other end to the knife slide, which means that the automatically controlled reciprocating movement of the knife slide is transmitted to the knife slide. As a result, the control of the knife slide is derived from a higher-order drive of the movable slide, with the slide being used, for example, for driving in and/or shaping the stitching wire staple in the stack of sheet materials.

In accordance with an added feature of the invention, the stroke of the knife slide which can be produced by the operating device corresponds substantially only to the stitching wire thickness or just exceeds the stitching wire thickness or just the stitching wire thickness of the thickest stitching wire which is intended to be processed by the stitching device. Furthermore, the openings in the stitching head base body and in the cutting box are advantageously slots, with the slots being offset by 90° in relation to each other. The slot in the cutting box results from the requirement to move the operating device, when it is introduced into the three openings in the stitching head base body, cutting box and knife slide, in the manner of a lever, so that the slot predefines the direction of the lever movement. The slot in the stitching head base body permits the ability of the cutting box to be displaced along the direction of the wire on the stitching head base body, which means that an influence can be exerted on the optimal position of the stitching wire. Otherwise, the opening in the stitching head base body is advantageously a blind hole, which limits the insertion depth of the operating device through the three openings in the stitching head base body, in the cutting box and through the knife slide. This opening is particularly advantageously lined with a resilient material.

With the objects of the invention in view, there is also provided a method for setting up an automatic stitching device. The method comprises providing a stitching device, and producing interaction between the operating device and the cutting box and the knife slide by inserting the operating device through the at least partly aligned openings in the cutting box and the knife slide. The knife slide is manually displaced by moving the inserted operating device to cut off a cut wire length of the stitching wire.

Other features which are considered as characteristic for the invention are set forth in the appended claims.

Although the invention is illustrated and described herein as embodied in a stitching device and a method for setting up a stitching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Referring now in detail to FIGS. 1 to 5 of the drawings as a whole, there is seen an embodiment of a stitching device 100 according to the invention which is restricted to a representation and description of details that are important to the invention. Further elements required for the operation of the stitching device, such as guidance, control, drives, fixing devices and so on, which in particular do not differ from the prior art either or are modeled thereon, will not be described further and/or will be left out for the sake of clarity.

Figure 1:
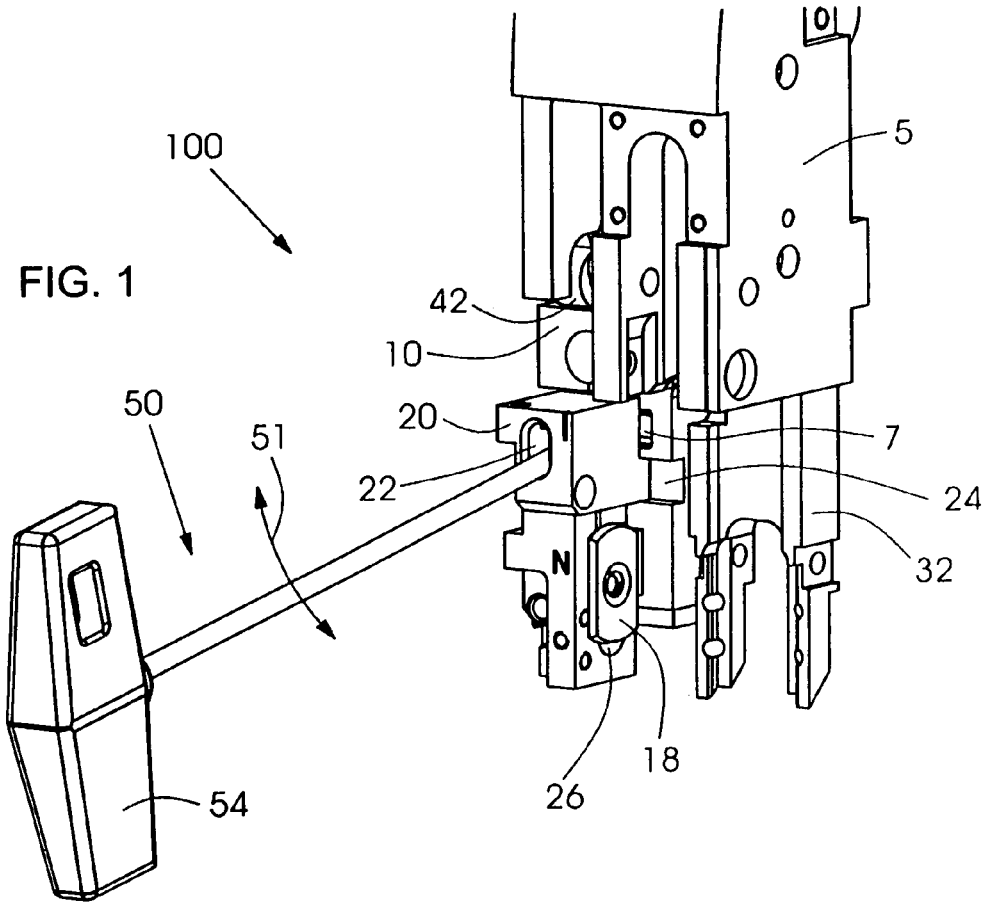
FIG. 1 is a fragmentary, diagrammatic, perspective view of a stitching device according to the invention with an inserted operating device in an upper position.
Figure 2:
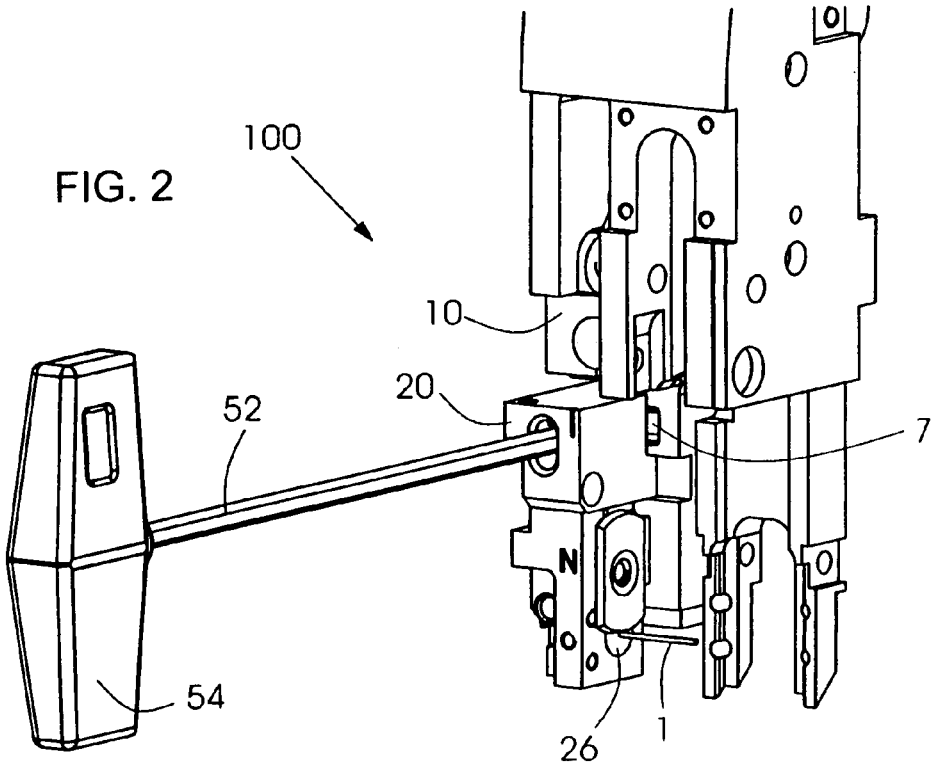
FIG. 2 is a view similar to FIG. 1 of the stitching device according to the invention, in which the stitching wire has been cut off manually through the use of the operating device.

The stitching device 100 according to the invention includes a stitching head base body 5 on which, inter alia, a slide 32 is mounted in such a way that it can move vertically, and a cutting box 20 can be displaced horizontally along a groove 24. Part of the cutting box 20, which during normal operation is immovably connected to the stitching head base body 5, is a knife slide 10. A knife 18 is fitted to the knife slide 10. The knife slide 10 is guided within the cutting box 20 and can be moved from an upper position into a lower position. The lower position is illustrated in FIG. 1. In this lower position of the knife slide 10, the knife 18 covers an opening of a circular knife 26. As illustrated in FIG. 2, a stitching wire 1 can be pushed forward through the opening of the circular knife 26 when the knife slide 10 is in the upper position.

Figure 3:
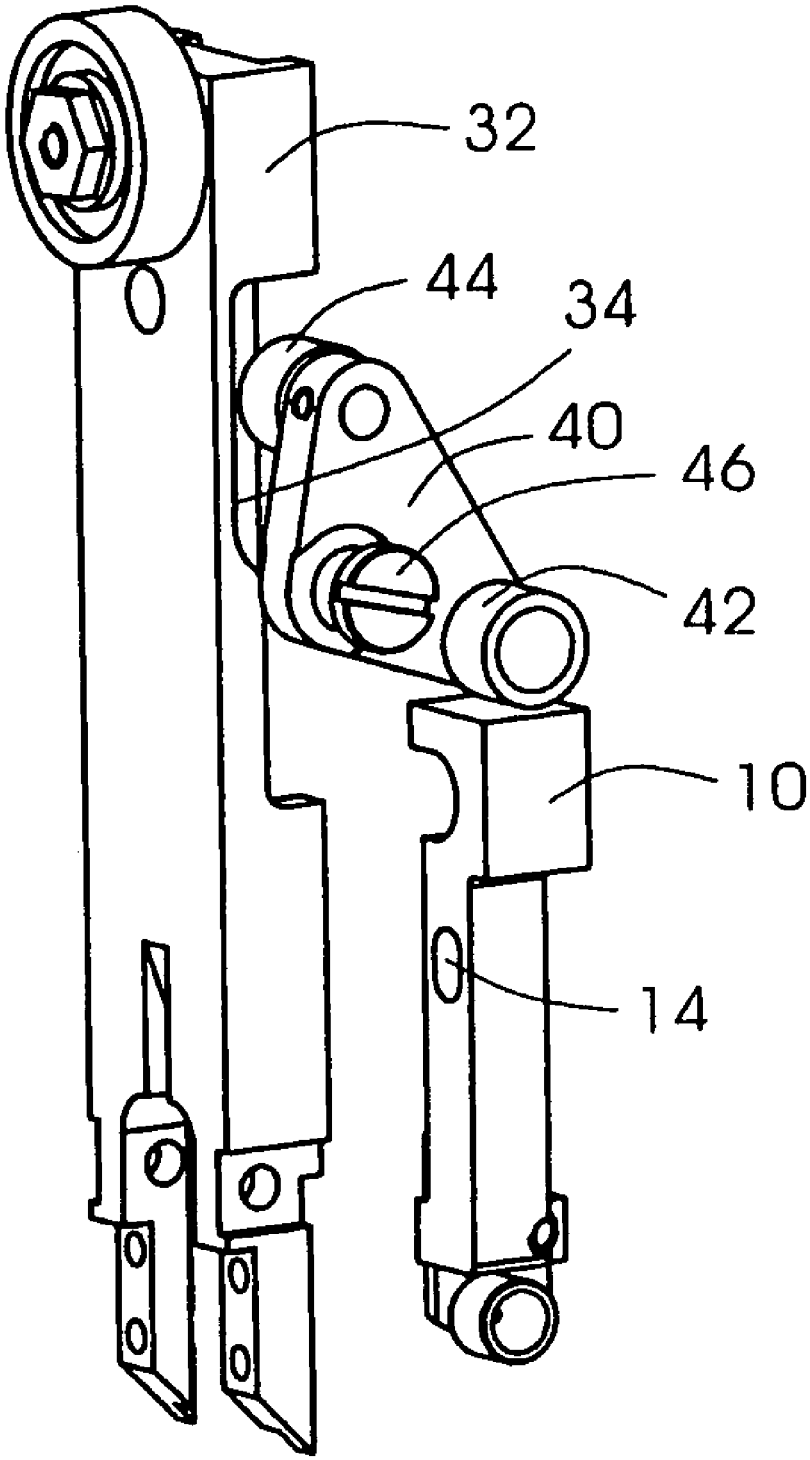
FIG. 3 is a perspective view illustrating details of automatic operation of a knife slide.

As can be seen in FIG. 3, during normal operation of the stitching device 100, the stitching wire 1 is cut off through interaction between the slide 32, on which a control device in the form of a cam surface 34 is formed, and a rocker 40. The rocker 40 is fixed to the stitching head base body 5 at a pivot 46 and has a first running roller 42 and a second running roller 44. The second running roller 44 is in contact with the cam surface 34 on the slide 32. If the slide 32 is raised sufficiently far, the rocker 40 tilts in the clockwise direction about the pivot 46 in the view illustrated in FIG. 3, as a result of which the rocker 40 with the first running roller 42 displaces the knife slide 10 downward in the cutting box 20. A return movement is carried out, for example, through the use of a non-illustrated spring, which is prestressed by the downward movement of the knife slide 10.

Figure 4:
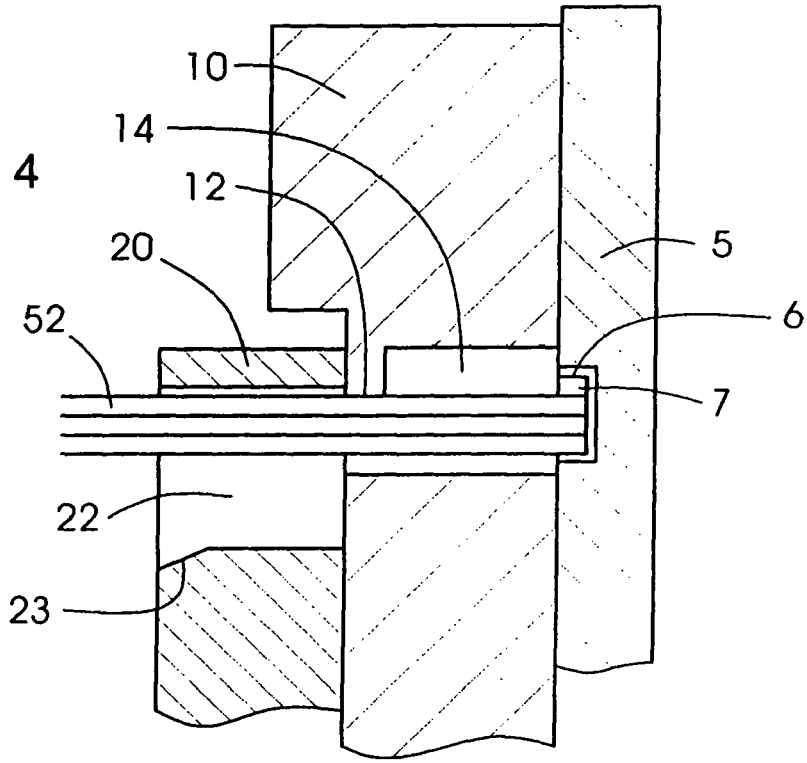
FIG. 4 is a fragmentary, sectional view showing an exaggerated illustration in order to clarify interaction between the operating device, a cutting box, the knife slide and a stitching head base body in the upper position.
Figure 5:
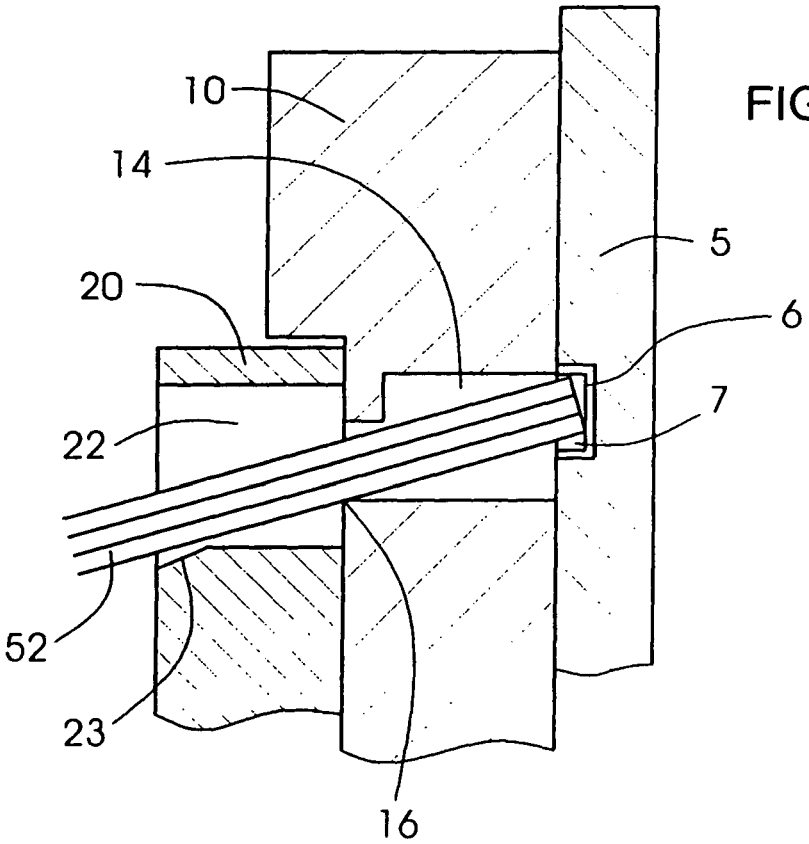
FIG. 5 is a view similar to FIG. 4 showing an exaggerated illustration in order to clarify the interaction between the operating device, the cutting box, the knife slide and the stitching head base body in a lower position.

If a wire is to be cut off manually in a setup operation during a stoppage of the stitching device, with guards open, then an operator is able to insert an operating device 50 having at least one handle 54 and a lever 52 into the stitching device 100, as is shown in FIG. 4 and FIG. 5. The cutting box 20 has a slot 22 for this purpose. An opening 14 in the knife slide 10 is in alignment with this slot 22 of the cutting box 20, and an opening 7 in the stitching head base body 5 is in alignment with the opening 14. The opening 7 in the stitching head base body 5 is constructed as a blind hole 7 as a limit to the three aligned openings.

In FIG. 4 the knife slide is shown in the upper position again. The lever 52 of the operating device 50 is supported on one side on an upper support point 12 in the knife slide 10 and on the other side on a lower edge of the opening 7 in the stitching head base body 5 or on resilient material 6 which lines the blind hole 7 in the stitching head base body 5. In this way, the knife slide 10 can be pushed into the uppermost position. Alternatively, the upper support surface 12 can be omitted, for example if the upward movement of the knife slide 10 is carried out on its own, for example by the knife slide 10 being prestressed in this direction by a spring.

Then, if the operating device 50 is tilted in a direction of movement identified by a designation 51, the lever 52 comes to rest on one side on the upper edge of the blind hole 7 on the stitching head base body 5 and on the other side on the knife slide 10 on a lower support point 16, which is located at a left-hand portion of the opening 14 of the knife slide 10 in FIG. 5. Through the use of the lever movement of the operating device 50, the knife 18 can then be pushed manually over the opening in the circular knife 26, and therefore the stitching wire 1 can be severed. The cutting box 20 advantageously has a chamfer 23 in its slot 22, at least at the bottom, which prevents the operating device 50 from striking the cutting box 20. Thus the chamfer 23 represents a lower limit of the movement of the lever 52. After the stitching wire 1 has been cut off, the knife slide 10 is brought into the upper position again, either by spring force or by pushing the knife slide 10 back through the use of the operating device 50.

As can be seen in FIG. 1, the blind hole 7 in the stitching head base body 5 is likewise configured as a slot, in order to also ensure the function of cutting off the stitching wire manually according to the invention for different positions of the cutting box 20 along the groove 24.

We claim:

1. A stitching device for producing stitching wire staples for stitching stacked sheet materials, the stitching device comprising:

a stitching head base body;

a cutting box fixed to said stitching head base body, said cutting box including a movable knife slide;

a control device for controlling movement sequences of the stitching device, for automatically cutting off the stitching wire;

said stitching head base body, said cutting box and said knife slide cooperating to permit said movable knife slide to be displaced relative to said stitching base body for cutting off the stitching wire; and an operating device being separate from and detachable from said stitching head base body, said cutting box and said knife slide, said operating device having a handle and a lever to be inserted through at least partly aligned openings formed in said cutting box and said knife slide to permit the stitching wire to be cut off manually.

2. The stitching device according to claim 1, wherein said control device controls movement sequences of said knife slide.

3. The stitching device according to claim 1, wherein said stitching head base body has an opening formed therein being at least partly aligned with said openings formed in said cutting box and said knife slide, said operating device cooperating with all of said openings to permit the stitching wire to be cut off manually.

4. The stitching device according to claim 3, wherein said openings in said stitching head base body and in said cutting box are slots being mutually offset by substantially 90°.

5. The stitching device according to claim 3, wherein said opening in said stitching head base body is a blind hole.

6. The stitching device according to claim 3, which further comprises a resilient material lining said opening in said stitching head base body.

7. The stitching device according to claim 1, wherein said control device is a cam control device.

8. The stitching device according to claim 1, wherein said operating device is fixed.

9. The stitching device according to claim 1, wherein said cutting box is mounted for displacement in direction of the wire in said stitching head base body.

10. The stitching device according to claim 1, wherein said knife slide has a stroke to be produced by said operating device, and said stroke corresponds substantially to a stitching wire thickness.

11. A method for setting up an automatic stitching device, the method comprising the following steps:

providing a stitching device according to claim 1;

producing interaction between said operating device and said cutting box and said knife slide by inserting said lever of said separate and detachable operating device through said at least partly aligned openings in said cutting box and said knife slide; and manually displacing said knife slide by moving said inserted operating device with said handle to cut off a cut wire length of the stitching wire.

12. The method according to claim 11, which further comprises:

measuring an actual length of the stitching wire cut off manually; and correcting the cut wire length in accordance with a result of the measuring step.

* * * * *